US005607024A

United States Patent [19]

Keith et al.

[11] Patent Number: 5,607,024

[45] Date of Patent: Mar. 4, 1997

[54] STABILITY ENHANCED DRILL BIT AND CUTTING STRUCTURE HAVING ZONES OF VARYING WEAR RESISTANCE

[75] Inventors: Carl W. Keith, Spring; Graham Mensa-Wilmot, Houston, both of Tex.

[73] Assignee: Smith International, Inc., Houston, Tex.

[21] Appl. No.: 400,147

[22] Filed: Mar. 7, 1995

[51] Int. Cl.[6] ..... E21B 10/46

[52] U.S. Cl. ..... 175/431; 175/432

[58] Field of Search ..... 175/415, 417, 175/420.1, 420.2, 431, 432, 374

[56] References Cited

U.S. PATENT DOCUMENTS

| | | | |
|---|---|---|---|
| 4,722,405 | 2/1988 | Langford, Jr. | 175/426 X |
| 5,007,207 | 4/1991 | Phaal | 175/432 X |
| 5,435,403 | 7/1995 | Tibbitts | 175/432 |

FOREIGN PATENT DOCUMENTS

| | | | |
|---|---|---|---|
| 0554568 | 11/1993 | European Pat. Off. | E21B 10/56 |

*Primary Examiner*—William P. Neuder

*Attorney, Agent, or Firm*—Gregory L. Maag; Conley, Rose & Tayon, P.C.

[57] ABSTRACT

A fixed cutter drill bit and cutting structure are disclosed which include cutter elements having cutting faces with different abrasion resistances. The cutter elements are spaced apart on the bit face so as to provide a bit cutting profile having abrasion resistance gradients. As wear occurs, the cutting structure assumes a cutting profile that creates grooves and ridges in the formation material to provide enhanced bit stabilization. Regions of differing abrasion resistances may also be provided on the individual cutting faces to provide a cutting profile that enhances bit stabilization. Further, the cutting structure may include substrate members that support the cutting faces and that themselves are made of materials having differing degrees of abrasion resistance. Providing these regions of differing wear resistance along the bit face tends to increase the bit's ability to resist vibration and provides an aggressive cutting structure, even after significant wear has occurred.

36 Claims, 5 Drawing Sheets

FIG. 3
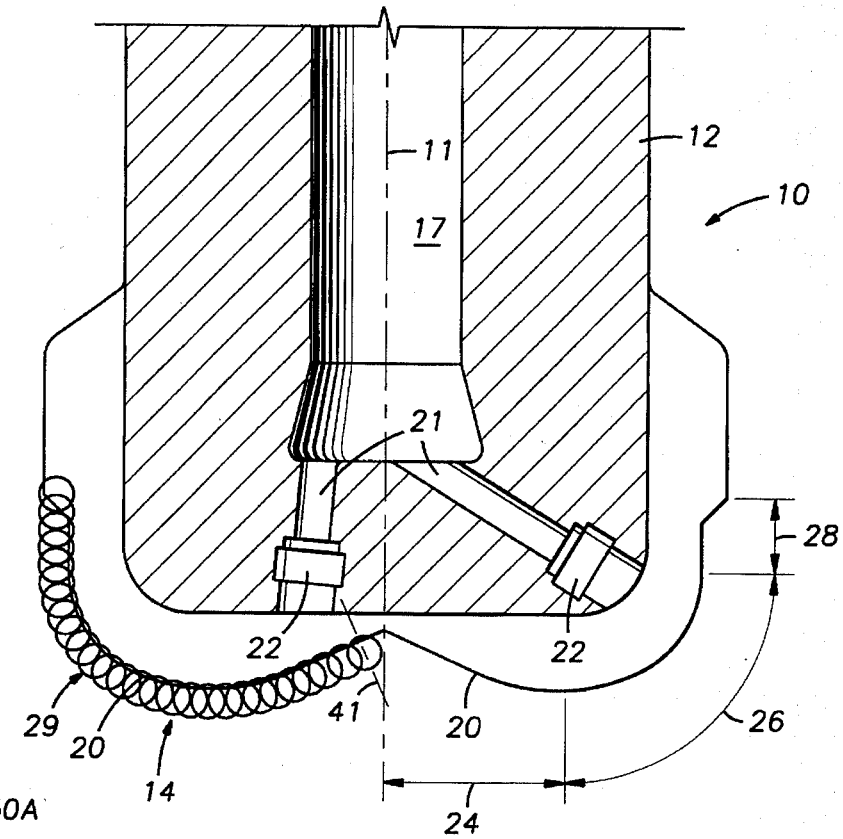
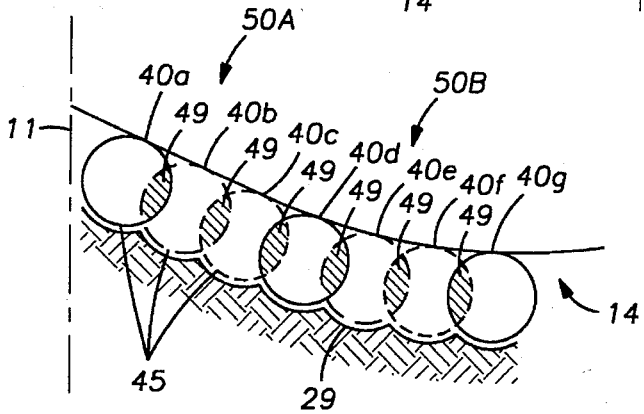
FIG. 4
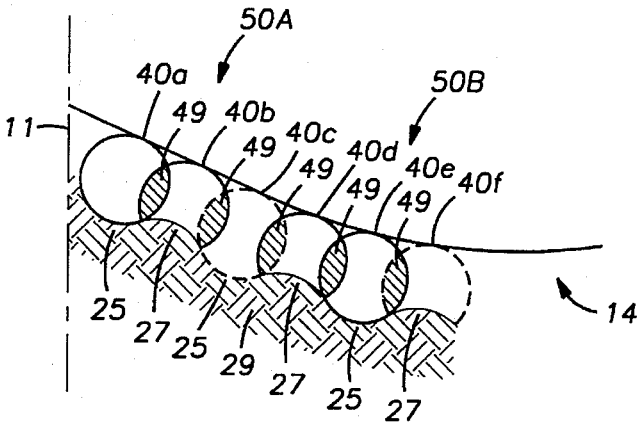
FIG. 5

STABILITY ENHANCED DRILL BIT AND CUTTING STRUCTURE HAVING ZONES OF VARYING WEAR RESISTANCE

FIELD OF THE INVENTION

This invention relates generally to fixed cutter drill bits such as the type typically used in cutting lock formation when drilling an oil well or the like. More particularly, the invention relates to bits utilizing polycrystalline diamond compacts (PDC's) that are mounted on the face of the drill bit, such bits typically referred to as "PDC" bits.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downwardly, causing the bit to cut through the formation material by either abrasion, fracturing, or shearing action, or through a combination of all cutting methods. While the bit is rotated, drilling fluid is pumped through the drill string and directed out of the drill bit through nozzles that are positioned in the bit face. The drilling fluid is provided to cool the bit and to flush cuttings away from the cutting structure of the bit. The drilling fluid and cuttings are forced from the bottom of the borehole to the surface through the annulus that is formed between the drill string and the borehole.

Many different types of drill bits and bit cutting structures have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In formations of soft and medium hardness, fixed cutter bits having a PDC cutting structure have been employed with varying degrees of success.

The cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed, the entire drill string—which may be miles long—must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before the drill string must be tripped and the bit changed depends upon the bit's rate of penetration ("ROP"), as well as its durability or ability to maintain a high or acceptable ROP. Additionally, a desirable characteristic of the bit is that it be "stable" and resist vibration. The most severe type or mode of vibration is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and a loss of penetration rate.

In recent years, the PDC bit has become an industry standard for cutting formations of soft and medium hardnesses. The cutter elements used in such bits are formed of extremely hard materials and include a layer of polycrystalline diamond material. In the typical PDC bit, each cutter dement or assembly comprises an elongate and generally cylindrical support member which is received and secured in a pocket formed in the surface of the bit body. A disk or tablet-shaped, preformed cutting element having a thin, hard cutting layer of polycrystalline diamond is bonded to the exposed end of the support member, which is typically formed of tungsten carbide. Although such cutter elements historically were round in cross section and included a disk shaped PDC layer forming the cutting face of the element, improvements in manufacturing techniques have made it possible to provide cutter elements having PDC layers formed in other shapes as well.

A common arrangement of the PDC cutting elements was at one time to place them in a spiral configuration. More specifically, the cutter elements were placed at selected radial positions with respect to the central axis of the bit, with each element being placed at a slightly more remote radial position than the preceding element. So positioned, the path of all but the center-most elements partly overlapped the path of movement of a preceding cutter element as the bit was rotated.

Although the spiral arrangement was once widely employed, this arrangement of cutter elements was found to wear in a manner to cause the bit to assume a cutting profile that presented a relatively flat and single continuous cutting edge from one element to the next. Not only did this decrease the ROP that the bit could provide, it but also increased the likelihood of bit vibration. Both of these conditions are undesirable. A low ROP increases drilling time and cost, and may necessitate a costly trip of the drill string in order to replace the dull bit with a new bit. Excessive bit vibration will itself dull the bit or may damage the bit to an extent that a premature trip of the drill string becomes necessary.

Thus, in addition to providing a bit capable of drilling effectively at desirable ROP's through a variety of formation hardnesses, preventing bit vibration and maintaining stability of PDC bits has long been a desirable goal, but one which has not always been achieved. Bit vibration may occur in any type of formation, but is most detrimental in the harder formations. As described above, the cutter elements in many prior art PDC bits were positioned in a spiral relationship which, as drilling progressed, wore in a manner which caused the ROP to decrease and which also increased the likelihood of bit vibration.

There have been a number of designs proposed for PDC cutting structures that were meant to provide a PDC bit capable of drilling through a variety of formation hardnesses at effective ROP's and with acceptable bit life or durability. For example, U.S. Pat. No. 5,033,560 (Sawyer et al.) describe a PDC bit having mixed sizes of PDC cutter elements which are arranged in an attempt to provide improved ROP while maintaining bit durability. The '560 patent is silent as to the ability of the bit to resist vibration and remain stable. Similarly, U.S. Pat. No. 5,222,566 (Taylor et at.) describes a drill bit which employs PDC cutter elements of differing sizes, with the larger size elements employed in a first group of cutters, and the smaller size employed in a second group. This design, however, suffers from the fact that the cutter elements do not share the cutting load equally. Instead, the blade on which the larger sized cutters are grouped is loaded to a greater degree than the blade with the smaller cutter elements. This could lead to blade failure. U.S. Pat. No. Re 33,757 (Weaver) describes still another cutting structure having a first row of relatively sharp, closely-spaced cutter elements, and a following row of widely-spaced, blunt or rounded cutter elements for dislodging the formation material between the kerfs or grooves that are formed by the sharp cutters. While this design was intended to enhance drilling performance, the bit includes no features directed toward stabilizing the bit once wear has commenced. Further, the bit's cutting structure has been found to limit the bit's application to relatively brittle formations.

Separately, other attempts have been made at solving bit vibration and increasing stability. For example, U.S. Pat. No. Re 34,435 (Warren et al.) describes a bit intended to resist vibration that includes a set of cutters which are disposed at an equal radius from the center of the bit and which extend further from the bit face than the other cutters on the bit. According to that patent, the set of cutters extending furthest from the bit face are provided so as to cut a circular groove within the formation. The extending cutters are designed to ride in the groove in hopes of stabilizing the bit. Similarly, U.S. Pat. No. 5,265,685 (Keith et at.) discloses a PDC bit that is designed to cut a series of grooves in the formation such that the resulting ridges formed between each of the concentric grooves tend to stabilize the bit. U.S. Pat. No. 5,238,075 (Keith et at.) also describes a PDC bit having a specific cutter element arrangement with differently sized cutter elements which, in part, was hoped to provide greater stabilization. However, many of these designs aimed at minimizing vibration required that drilling be conducted with an increased weight-on-bit ("WOB") as compared with bits of earlier designs. Drilling with an increased or heavy WOB has serious consequences and is avoided whenever possible. Increasing the WOB is accomplished by installing additional heavy drill collars to the drill string. This additional weight increases the stress and strain on all drill string components, causes stabilizers to wear more quickly and to work less efficiently, and increases the hydraulic pressure drop in the drill string, requiring the use of higher capacity (and typically higher cost) pumps for circulating the drilling fluid.

Thus, despite attempts and certain advances made in the art, there remains a need for a fixed cutter bit having an improved cutter arrangement that will permit the bit to drill effectively at economical ROP's, and that will provide an increased measure of stability as wear occurs on the cutting structure of the bit so as to resist bit vibration. More specifically, there is a need for a PDC bit which can drill in soft, medium, medium hard and even in some hard formations while maintaining an aggressive cutter profile so as to maintain a superior ROP's for acceptable lengths of time and thereby lower the drilling costs presently experienced in the industry. Such a bit should offer increased stability without having to employ substantial additional WOB and suffering from the costly consequences which arise from drilling with such extra weight.

SUMMARY OF THE INVENTION

Accordingly, there is provided herein a cutting structure and drill bit particularly suited for drilling through a variety of formation hardnesses with normal WOB at improved penetration rates while maintaining stability and resisting bit vibration. The invention generally includes a cutting structure having a first and a second cutter element for cutting separate kerfs in formation material. The first cutter element includes a cutting face that is more resistant to abrasion than the cutting face of the second cutter element. Such cutting faces may be made from polycrystalline diamond layers that are mounted on tungsten carbide support members. In one embodiment of the invention, the diamond layer of the second cutting face has an average diamond grain size that is at least twice as large as the average diamond grain size of the diamond layer of the first cutting face. Any of a variety and number of abrasion resistances can be employed in the invention. For example, the invention may include three different abrasion resistances.

The first and second cutter elements may be arranged in sets and mounted in radial positions such that the cutting profiles of the cutter elements partially overlap when viewed in rotated profile. The cutter sets may include a group of redundant cutter elements having the same radial position as the first cutter element, and another group of redundant cutter elements in the same radial position as the second cutter element. In one embodiment, all redundant cutters in a given radial position will have the same abrasion resistance. In another embodiment, some of the cutter elements in redundant positions to the second cutter element (the element having a cutting face with a relatively low abrasion resistance) will have the same abrasion resistance as the first cutter element (having the relatively high abrasion resistance), although in the preferred embodiment, there will be more cutter elements in the second radial position having the second abrasion resistance than having the first abrasion resistance.

The cutter element sets include set cutting profiles as defined by the cutting profiles of the cutting faces of the individual cutter elements in the set. By including cutter elements having differing abrasion resistances within each set, regions or zones of varying abrasion resistance are created within a set, such regions being separated by the areas of overlap between the cutting profiles of cutter elements that are radially adjacent when viewed in rotated profile. The differences or gradients in abrasion resistance within the set cutting profile helps establish regions of the set cutting profile that will wear faster than other regions so as to create a cutting profile that tends to stabilize the bit by forming a series of grooves and ridges in the formation material.

In another embodiment of the invention, the substrate or support members that support the cutting faces of the cutter elements in a set are made from materials having differing abrasion resistances. In one embodiment, the support members supporting cutting faces having a relatively high abrasion resistance will themselves be made of a material having a relatively high abrasion resistance, while the support members supporting cutting faces having lower abrasion resistances will be made of material that will wear more quickly.

The invention also includes cutter elements having regions of differing abrasion resistance on the cutting face of the individual element. It is preferred that a region having a relatively high abrasion resistance be centrally disposed on the cutting face, and flanked by a pair of peripheral regions that are less abrasion resistant. The central region may be pointed or scribe shaped. The abrasion resistances of the peripheral regions may be substantially the same, or they may differ. In either case, the peripheral regions, being less wear resistant, will tend to wear quicker than the central region, such that the central region will tend to form a well-defined groove within the formation material to enhance stability. The invention includes sets of such cutter elements where, in rotated profile, the elements are radially spaced and have cutting profiles that overlap in their peripheral regions. This arrangement creates a set cutting profile having alternating regions of relatively high and relatively low abrasion resistances that are separated by regions of multiple diamond density. This :arrangement also provides enhanced stability by creating a series of concentric grooves and ridges in the formation material as the cutting profile of the cutter set wears.

As the bit rotates in the borehole, a portion of the cutting profile of each cutter element in the set is partially hidden from the formation material by other cutter elements in the same set. As the bit wears, the regions of maximum diamond density remain well-defined in rotated profile and suffer from less wear than the adjacent regions having lesser diamond densities. Thus, the bit face presents varying diamond densities and different wear gradients along the bit cutting structure profile. As drilling progresses, this design creates a pattern of alternating grooves and ridges in the formation material tending to stabilize the bit, without requiring the increased WOB as was often necessary to drill with prior art bits where increased stability was desired.

In still other embodiments of the invention, the cutting faces may include irregularly shaped regions or asymmetrically shaped regions of differing abrasion resistance. In these embodiments, the high abrasion or wear resistant regions may be either centrally or peripherally positioned on the cutting face.

Thus, the present invention comprises a combination of features and advantages which enable it to substantially advance the drill bit art by providing apparatus for effectively and efficiently drilling through a variety of formation hardnesses at economic rates of penetration and with superior bit durability. The bit drills more economically than many prior art PDC bits and drills with less vibration and greater stability, even after substantial wear has occurred to the cutting structure of the bit. Further, drilling with the bit does not also require additional or excessive WOB. The and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiment of the invention, reference will now be made to the accompanying drawings, wherein:

FIG. 3 is an elevational view, partly in cross-section, of the drill bit shown in FIG. 1 with the cutter elements shown in rotated profile collectively on one side of the central axis of the drill bit FIG. 4 is an enlarged view showing schematically, in rotated profile, the relative radial positions of certain of the cutter elements and cutter element sets of the cutting structure shown in FIGS. 1–3.

FIG. 5 is a view similar to FIG. 4 showing, in rotated profile, the cutter elements and cutter element sets shown in FIG. 4 after wear has occurred.

DESCRIPTION OF THE PREFERRED EMBODIMENT

Figure 1:
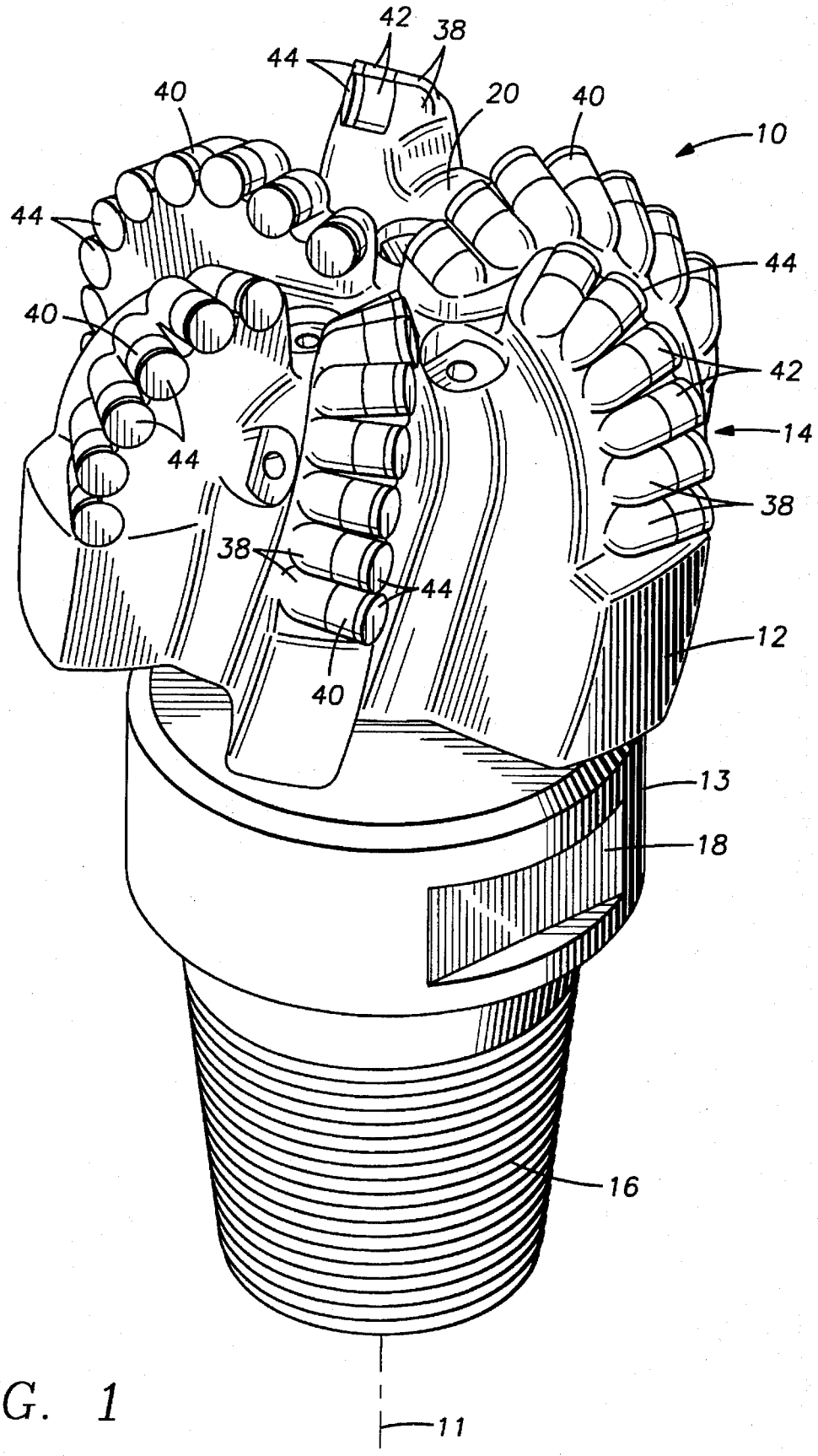
FIG. 1 is a perspective view of a drill bit and cutting structure made in accordance with the present invention.
Figure 2:
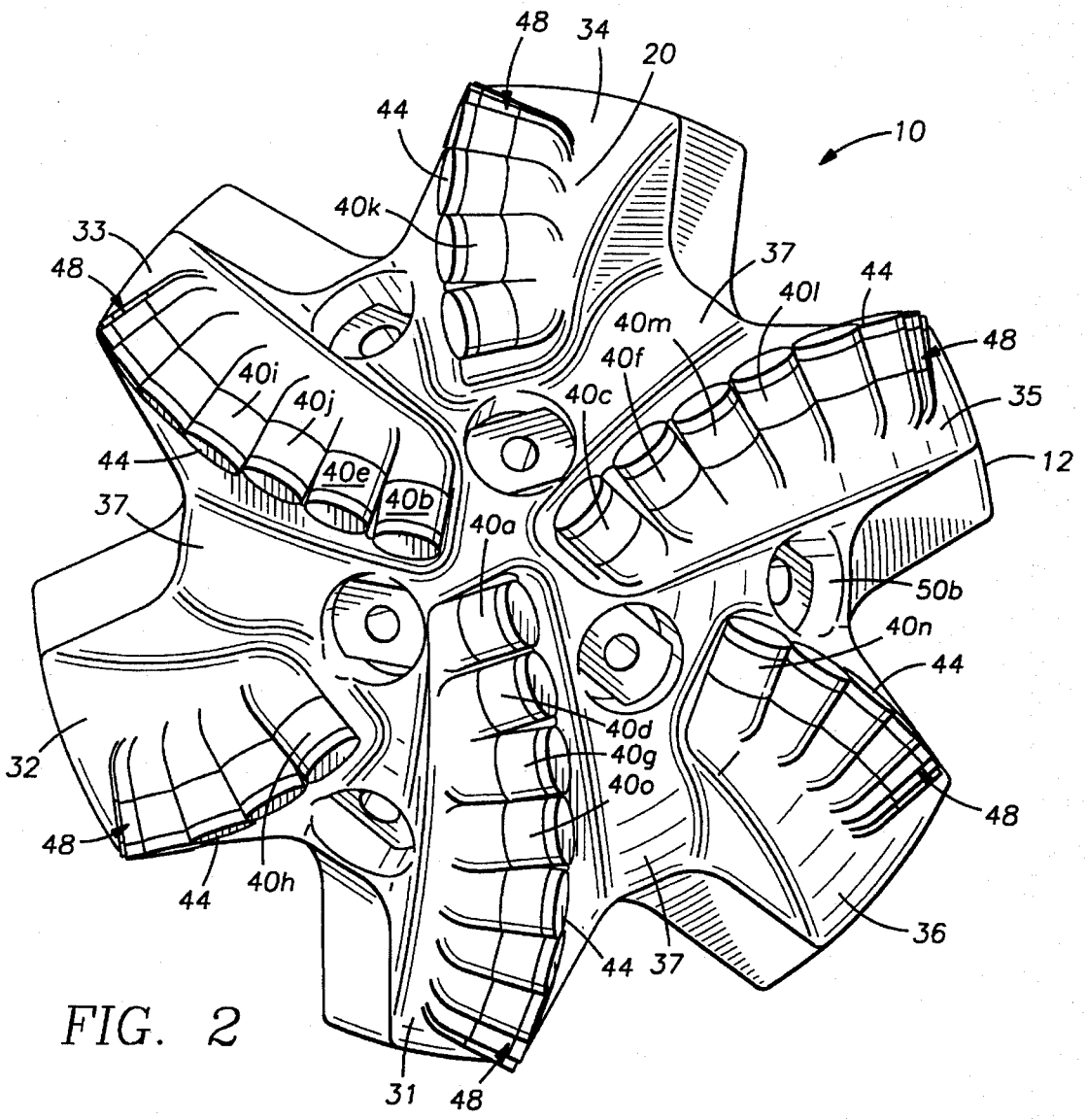
FIG. 2 is a plan view of the cutting end of the drill bit shown in FIG. 1.

A drill bit 10 and PDC cutting structure 14 embodying the features of the present invention are shown in FIGS. 1–3. Bit 10 is a fixed cutter bit, sometimes referred to as a drag bit, and is adapted for drilling through formations of rock to form a borehole. Bit 10 generally includes a central axis 11, a bit body 12, shank 13, and threaded connection or pin 16 for connecting bit 10 to a drill string (not shown) which is employed to rotate the bit 10 to drill the borehole. A central longitudinal bore 17 (FIG. 3) is provided in bit body 12 to allow drilling fluid to flow from the drill string into the bit. A pair of oppositely positioned wrench flats 18 (one shown in FIG. 1) are formed on the shank 13 and are adapted for fitting a wrench to the bit to apply torque when connecting and disconnecting bit 10 from the drill string.

Bit body 12 also includes a bit face 20 which is formed on the end of the bit 10 that is opposite pin 16 and which supports cutting structure 14. As described in more detail below, cutting structure 14 includes rows of cutter elements 40 having cutting faces 44 for cutting the formation material. Body 12 is formed in a conventional manner using powdered metal tungsten carbide particles in a binder material to form a hard metal east matrix. Steel bodied bits, those machined from a steel block rather than a formed matrix, may also be employed in the invention. In the embodiment shown, bit face 20 includes six angularly spaced-apart blades 31–36 which are integrally formed as part of bit body 12. As best shown in FIG. 2, blades 31–36 extend radially across the bit face 20 and longitudinally along a portion of the periphery of the bit. Blades 31–36 are separated by grooves which define drilling fluid flow courses 37 between and along the cutting faces 44 of the cutter elements 40. In the preferred embodiment shown in FIG. 2, blades 31, 33 and 35 are equally spaced approximately 120° apart, while blades 32, 34 and 36 lag behind blades 31, 33 and 35, respectively, by about 55°. Given this angular spacing, blades 31–36 may be considered to be divided into pairs of "leading" and "lagging" blades, a first such blade pair comprising blades 31 and 32, a second pair comprising blades 33 and 34, and a third pair including blades 35 and 36.

As best shown in FIG. 3, body 12 is also provided with downwardly extending flow passages 21 having nozzles 22 disposed at their lowermost ends. It is preferred that bit 10 include six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Referring still to FIG. 3, to aid in an understanding of the more detailed description which follows, bit face 20 may be said to be divided into three portions or regions 24, 26, 28. The most central portion of the bit face 20 is identified by the reference numeral 24 and may be concave as shown. Adjacent central portion 24 is the shoulder or the upturned curved portion 26. Next to shoulder portion 26 is the gage portion 28, which is the portion of the bit face 20 which defines the diameter or gage of the borehole drilled by bit 10. As will be understood by those skilled in the art, the boundaries of regions 24, 26, 28 are not precisely delineated on bit 10, but are instead approximate, and are identified relative to one another for the purpose of better describing the distribution of cutter elements 40 over the bit face 20.

As best shown in FIG. 1, each cutter element 40 is mounted within a pocket 38 which is formed in the bit face 20 on one of the radially and longitudinally extending blades 31–36. Cutter elements 40 are constructed as to include a substrate or support member 42 having one end secured within a pocket 38 by brazing or similar means. The support member 42 is comprised of a sintered tungsten carbide material having a hardness and resistance to abrasion that is selected so as to be greater than that of the body matrix material. Attached to the opposite end of the support member 42 is a layer of extremely hard material, preferably a synthetic polycrystalline diamond material which forms the cutting face 44 of element 40. Such cutter elements 40 are generally known as polycrystalline diamond composite compacts, or PDC's. Methods of manufacturing PDC compacts and synthetic diamond for use in such compacts have long been known. Examples of these methods are described, for example, in U.S. Pat. Nos. 5,007,207, 4,972,637, 4,525,178, 4,036,937, 3,819,814 and 2,947,608, all of which are incorporated herein by this reference. PDC's are commercially available from a number of suppliers including, for example, Smith Sii Megadiamond, Inc., General Electric Company DeBeers Industrial Diamond Division, or Dennis Tool Company. As explained below, the present invention contemplates employing cutting faces 44 having differing degrees of abrasion resistances. As also described below, the abrasion resistance of the supports 42 may also vary for different cutter elements 40.

As shown in FIGS. 1 and 2, the cutter elements 40 are arranged in separate rows 48 along the blades 31–36 and are positioned along the bit face 20 in the regions previously described as the central region or portion 24, shoulder 26 and gage portion 28. The cutting faces 44 of the cutter elements 40 are oriented in the direction of rotation of the drill bit 10 so that the cutting face 44 of each cutter element 40 engages the earth formation as the bit 10 is rotated and forced downwardly through the formation.

Each row 48 includes a number of cutter elements 40 radially spaced from each other relative to the bit axis 11. As is well known in the art, cutter elements 40 are radially spaced such that the groove or kerf formed by the cutting profile of a cutter element 40 overlaps to a degree with kerfs formed by certain cutter elements 40 of other rows 48. Such overlap is best understood in a general sense by referring to FIG. 4 which schematically shows, in rotated profile, the relative radial positions of certain of the most centrally located cutter elements 40, that is, those elements 40 positioned relatively close to bit axis 11 which have been identified in FIGS. 2 and 4 with the reference characters **40*a*–40*g*. The regions of overlap of the cutting profiles of radially adjacent cutter elements are identified by reference number 49 and represent regions of multiple diamond density. As understood by those skilled in the art, regions 49** having higher diamond density are less prone to wear than regions of low diamond density.

Referring now to FIGS. 2 and 4, elements **40*a*, 40*d* and 40*g* are radially spaced in a first row 48 on blade 31. As bit 10 is rotated, these elements will cut separate kerfs in the formation material, leaving ridges therebetween. As the bit 10 continues to rotate, cutter elements 40*b* and 40*c*, mounted on blades 33 and 35, respectively, will cut the ridge that is left between the kerfs made by cutter elements 40*a* and 40*d*. Likewise, elements 40*e* and 40*f* (also mounted on blades 33 and 35, respectively) cut the ridge between the kerfs formed by elements 40*d* and 40*g*. With this radial overlap of cutter element 40 profiles, the bit cutting profile may be generally represented by the slightly scalloped curve 29 (FIGS. 3 and 4) formed by the outer-most edges or cutting tips 45 of cutting faces 44, the cutting faces 44 being depicted in FIGS. 3 and 4 in rotated profile collectively on one side of central bit axis 11**.

As will be understood by those skilled in the art, certain cutter elements 40 are positioned on the bit face 20 at generally the same radial position as other elements 40 and therefore follow in the same swath or kerf that is cut by a preceding cutter dement 40. As used herein, such elements are referred to as "redundant" cutters. In the rotated profile of FIGS. 3 and 4, the distinction between such redundant cutter elements cannot be seen.

In addition to being mounted in rows 48, cutter elements 40 in the present invention are also arranged in groups or sets 50, each cutter set 50 including two, three or any greater number of cutter elements 40. A set 50 may include more than one cutter element 40 on the same blade 31–36 and, in the preferred embodiment of the invention, will include cutter elements 40 that are positioned on different blades and that have cutting profiles that overlap with the cutting profile of other cutter elements 40 of the same set 50.

Referring once again to FIG. 4, cutter element sets 50A, 50B are shown in rotated profile in relation to bit axis 11. Cutter element set 50A includes cutter elements 40*a–c*, and set 50B includes elements 40*d–f*. In this embodiment, the cutting faces 44 of elements 40*a–f* are generally circular and are mounted with zero degrees of backrake and siderake, thus the cutting profiles of cutting faces 44 of elements 40*a–f* are also substantially circular; however, it should be understood that the invention is not limited to any particular shape of cutting face or degree of backrake or side rake. Each set 50A, 50B includes a set cutting profile that consists of the combined areas of the cutting profiles of the cutter elements which comprise the set. The set cutting profiles of sets 50A and 50B themselves overlap in the region 49 that is formed by the overlap of the cutting profile of cutter elements 40*c* and 40*d*.

Referring to FIGS. 2 and 4, the cutter elements 40*a–c* of set 50A and elements 40*d–f* of set 50B are mounted on different blades of the bit. More specifically, elements 40*a* and *d*, are mounted on blade 31, elements 40*b* and 40*e* are mounted on blade 33 and elements 40*c* and 40*f* are mounted on blade 35. Each element 40*a–f* is mounted so as to have a differing radial position relative to bit axis 11. Although this embodiment of the invention is depicted in FIG. 2 on a six-bladed bit 10, the principles of the present invention can of course be employed in bits having any number of blades, and the invention is not limited to a bit having any particular number of blades or angular spacing of the blades. Further, although the cutter element arrangement of FIGS. 2 and 4 show each cutter element 40 in sets 50A and 50B to each be positioned on a different blade, depending on the number of cutter elements 40 in the set, the size of the elements, and the desired spacial relationship of the elements, more than one cutter element 40 in a set 50 may be positioned on the same blade.

Figure 6:
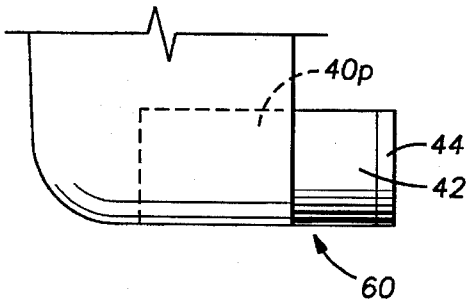
FIG. 6 is an elevation view showing a cutter element engaging the formation before wear has occurred.

Referring momentarily to FIG. 6, there is shown a side profile of single cutter element 40 having a cutting face 44 mounted on support member 42. As known to those skilled in the art, the cutting face 44 is a disk or tablet shaped form having polycrystalline diamond grains bonded within a binder comprised principally of cobalt. As previously described, this tablet or disk is then securely attached to the cylindrical support member 42 by means of a conventional high temperature and high pressure sintering process. Depending upon the average size of the diamond grains, the range of grain sizes and the distribution of the various grain sizes employed, cutting faces 44 may be made so as to have differing resistances to wear or abrasion. More specifically, it is known that, where binder content and grain size distribution are substantially the same, cutting faces having PDC surfaces formed of "fine" diamond grains will typically be more resistant to wear caused by abrasion than will a similar surface formed of larger average grain sizes. Although the industry is presently striving to achieve PDC surfaces of even smaller average grain size (and thus even greater resistance to abrasion), the present average grain size for "fine" grade PDC's is generally within the range of 25–30 μm.

At least one other relatively standard diamond grade is presently in industry-wide use, this second grade being less wear or abrasion resistant that the "fine" grain size PDC's described above. This second grade is made of coarser grains and has an average grain size within the range of 65–75 μm. As readily apparent, the "fine" grades of PDC's have an average grain size that is less than one half the average grain size of the coarser grain PDC's.

It is a principle of the present invention to vary the abrasion resistances of the cutting faces 44 of cutter elements 40 along at least portions of the bit cutting profile 29. More specifically, and referring again to FIG. 4, in accordance with one embodiment of the present invention, the cutting faces 44 of cutter elements 40*a*, 40*c* and 40*e* are provided with PDC cutting faces 44 having relatively high abrasion resistances. Cutting faces 44 of cutter elements 40*b*, 40*d* and 40*f* are provided with cutting faces having lower abrasion resistances than those of cutters 40*a*, 40*c* and 40*e*. Preferably, the cutting faces 44 of elements 40*a*, 40*c* and 40*e* are formed from a "fine" grade diamond layer such as General Electric Series 2700, Smith Sii Megadiamond D27 or DeBeers "fine" grade. Element 40*b*, 40*d* and 40*f* will have cutting faces formed of a less wear resistant diamond material, such as General Electric Series 2500 or Smith Sii Megadiamond D25B. Employing these presently-preferred abrasion resistances on cutter elements 40*a–f* creates a PDC cutting structure 14 in which the average diamond grain size on cutting faces 44 of cutter elements 40*b,d,f* are more than twice as great as the average diamond grain size of cutters 40*a,c,e*.

Referring still to FIGS. 1,2 and 4, as the bit 10 is rotated about axis 11, the blades 31–36 sweep around the bottom of the bore hole causing the cutter elements 40 to each cut a trough or kerf within the formation material. Because of the radial positioning of elements 40*a–*40*g*, certain portions of the cutting faces 44 are "hidden" from the formation material by radially adjacent cutter elements 40. For example, because of the overlap of the cutting profiles of elements 40*b*, 40*c* and 40*d*, the peripheral regions of element 40*c* which coincide with region 49 may be considered partially hidden from the formation material because the portion of the kerf that would otherwise be cut by element 40*c* has previously been cut by elements 40*b* and 40*d*. Thus, because the regions on cutting faces 44 that coincide with multiple diamond density regions 49 are not required to perform as much cutting as the unprotected or exposed regions of the cutting faces 44, those regions will wear more slowly as the bit 10 continues to drill. At the same time, the cutting faces 44 of elements 40*b*, 40*d* and 40*f*, will wear more quickly than elements 40*a*, 40*c* and 40*e* due to their possessing a lower abrasion resistance. Thus, as wear occurs, the cutting profile of the bit 10 will tend to assume the cutting profile 29' shown in FIG. 5. As shown in FIG. 5, cutting faces 44 of elements 40*a*, 40*c* and 40*e* will exhibit less wear than element 40*b*, 40*d* and 40*f*, and thus will tend to remain more exposed to the formation material. The cutting profile 29' shown in FIG. 5 thus creates well-defined ridges 27 and grooves 25 in the formation material and provides a substantial stabilizing effect to the drill bit 10 as the formation ridges 27 tend to prevent lateral movement of the bit. The areas of overlap 49 between adjacent cutters 40 create areas of multiple diamond density and tend to resist wear and also help establish the stabilizing grooves 25 in the formation.

Providing this pattern of varying abrasion resistance across the span of a set cutting profile and along the bit face 20 in combination with the areas of multiple diamond density helps the bit 10 maintain an aggressive cutting structure and prolongs the life of the bit. Simultaneously, the design provides a stabilizing effect on the bit and lessens the likelihood that damaging bit vibration will occur as the bit wears. Stabilization is achieved because, as the bit wears, the cutting faces 44 having the high abrasion resistant diamond layer (as well as the regions of multiple diamond density) remain relatively unworn, while the cutting faces 44 having the lower abrasion resistant diamond layers and which have less diamond density will wear much more quickly. Providing these cutting faces 44 of differing abrasion resistant diamond layers, and spacing apart the high resistance diamond layers along the bit face provides a bit that will cut in a series of concentric grooves 25 that are separated by well defined ridges 27 as shown in FIG. 5. These ridges will tend to make the bit highly resistant to lateral movement due to increased side loading provided by the ridges 27 on the cutter elements 40 of sets 50. Bit 10 will thus tend to remain stable and resist bit vibration.

Stabilization is best achieved by varying the abrasion resistances of cutting faces 44 of cutter elements 40 that are located generally in the central portion 24 and shoulder portion 26 of bit 10; however, the principles of the invention may also be employed in the gage region 28. Also, although the invention shown in FIGS. 4 and 5 have been described with reference to the currently-preferred abrasion resistance classifications, it should be understood that the substantial benefits provided by the invention may be obtained using any of a number of other gradients or differences in abrasion resistances. What is important to the invention is that there be a difference across the bit face 20 in the wear or abrasion resistances of the various cutter elements 40. Advantageously then, the principles of the invention may be applied using ever more wear resistant PDC cutters as they become commercially available in the future.

Likewise, although the arrangement shown in FIGS. 4 and 5 provides an alternating pattern of wear resistances between the cutter elements 40 having immediately adjacent radial positions, the pattern may vary substantially and still achieve substantial stabilization. For example, and referring again to FIG. 4, it may be found desirable in certain formations to provide cutter elements 40*a* and 40*d* with diamond layers having high abrasion resistances, while elements 40*b*, 40*c*, 40*e* and 40*f* may all have relatively low, or at least lower, abrasion resistances than that of elements 40*a* and 40*d*. As a further example, elements 40*a*, 40*b* and 40*e*, 40*f* may have cutter faces 44 with diamond layers having high abrasion resistances, with cutter elements 40*c* and 40*d* having less abrasion resistant diamond layers. Further, it should be understood that, although FIGS. 4 and 5 have shown the present invention embodied in cutter elements 40 having substantially round cutting faces 44, the principles of the present invention may be employed in scribe shaped cutters, or any of a number of other commercially available cutters.

It is preferred that the cutting structure 14 in bit 10 include sets 50 having redundant cutters 40 in at least certain radial positions on bit face 20. Within the limits imposed by the physical size and other design parameters of bit 10, any number of redundant cutters 40 in sets 50 may be positioned on the bit to yield desirable diamond densities at predetermined radial positions along the bit face.

Figure 8:
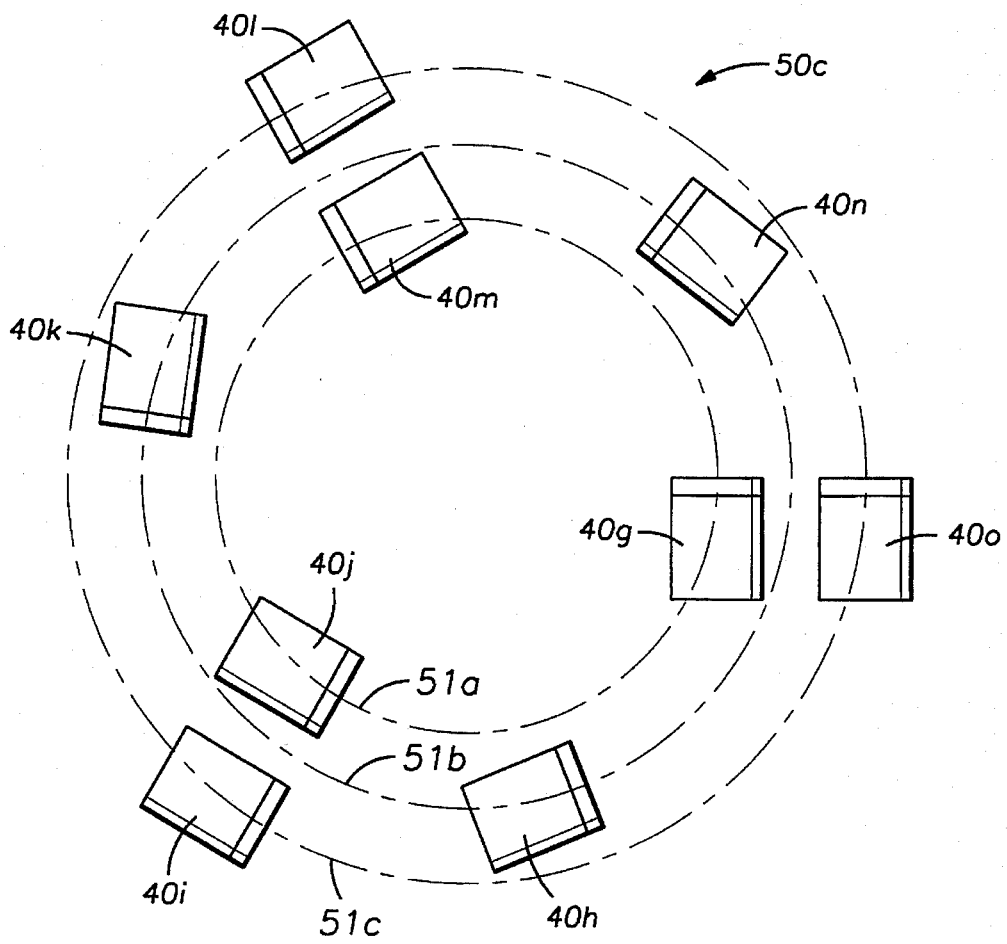
FIG. 8 is a schematic or diagrammatical view showing the cutting paths of one of the sets of cutter elements shown in FIGS. 1 and 2.
Figure 9:
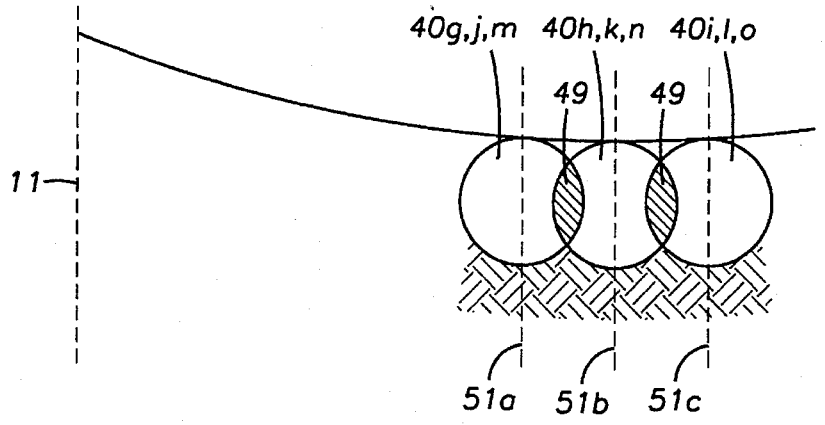
FIG. 9 is an elevation view showing the set cutting profile of the cutter elements shown in FIG. 8.

Referring to FIGS. 2, 8 and 9, there is shown a cutter element set 50C which includes cutter elements 40*g–o*. As best shown in FIG. 8, elements 40*g,h,i* are radially and angularly spaced apart on the bit face, each of elements 40*g,h,i* and *i* being positioned on a separate blade. Cutter elements 40*j*, *k* and *l* are redundant to elements 40*g,h,i* and are likewise each mounted on a separate blade. Finally, elements 40*m,n* and *o* are also redundant to cutters 40*g,h* and *i* and located on separate blades. The lines identified by reference numerals 51*a–c* designate the center lines of the cutting paths taken by the cutter elements 40*g–o*. Thus, it can be seen that elements 40*g*, *i* and *m* cut along path 51*a*. Likewise, elements 40*h,k* and *n* cut along path 51*b* and elements 40*i,l* and *o* cut along path 51*c*. Cutter elements 40*g–o* have circular cutting faces. Due to the radial spacing of the elements and the diameter of their cutting faces, the cutting profiles of cutting faces 44 of cutter elements 40*g*, 40*j* and 40*m* overlap, in rotated profile, with those of cutter elements 40*h*, *k*, *n* to create regions 49 of multiple diamond density (FIG. 9) in the regions of overlap between paths 51*a* and 51*b*. Likewise, in rotated profile, the cutting faces of cutter elements 40*h*, *k* and *n* overlap with those of cutter elements 40*i*, *l* and *o* to form regions of multiple diamond density 49 between paths 51*b* and 51*c*. In one embodiment of the invention, cutter elements 40*g*, *j* and *m* all include cutting faces 44 having diamond layers of high abrasion resistance. Cutter elements 40*h*, *k* and *n* have cutting faces 44 with diamond layers having a lower abrasion resistance than that of cutter elements 40*g*, *j* and *m*. The next adjacent group of cutters in the set 50C, elements 40*i*, *l* and *o*, again have high abrasion resistant diamond cutting faces 44. Such an arrangement would achieve the desired pattern of wear so as to create a stabilizing ridge in the formation material which would generally be centered along cutting path 51*b*.

As an alternative to the arrangement thus described, for example when it is determined that the cutter elements in the radial position of elements 40*h*, *k* and *n* might wear too quickly, one or more of those elements, for example, element 40*h*, may be provided with a diamond layer having a high abrasion resistance and still comply with the principles of the present invention. According to those principles, the cutting structure 14 of the bit 10 should have gradients in abrasion resistance along the bit cutting profile 29 upon moving from bit axis 11 toward the gage portion 28 (FIG. 3). Such gradients may be determined by comparing the number of cutter elements and the abrasion resistances of all the cutter elements 40 in a first radial position with the number of elements and the abrasion resistances of the redundant cutter elements located at a different radial position. In the example thus described, even with cutter element 40*h* being provided with a diamond layer having the same high wear resistance material as cutter elements 40*g* and 40*i*, the redundant cutter elements h, k and n will wear more quickly than the elements in the adjacent radial positions which have all high abrasion resistances. Thus, the desired gradient in abrasion resistances along the cutting profile 29 may still be achieved.

Figure 7:
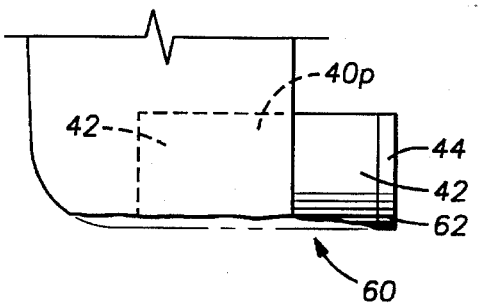
FIG. 7 is a view similar to FIG. 6 but showing the cutter element of FIG. 6 after wear has occurred.

Another embodiment of the present invention is best described with reference to FIGS. 6 and 7. Referring first to FIG. 6, there is shown a side profile of a cutter element 40*p* as it exists before any significant wear has occurred. As shown in FIG. 7, after some wear has occurred, such as after drilling in a hard formation, a certain portion or segment of the carbide support or substrate 42 tends to wear away in a region 60 behind the cutting face 44 forming a cutting lip 62. This wear phenomenon is well understood and occurs because the carbide used to form support member 42 is not as hard or wear resistant as the diamond material on the cutting faces 44. It is also known that this lip 62 is a desirable feature as it enhances cutting performance of the bit 10. In accordance with the present invention, the composition of the carbide substrate 42 supporting each cutting face 44 may likewise be varied depending upon the radial position in which the cutter element 40 is employed. More specifically, and referring again to FIGS. 4 and 5, the invention contemplates having a more wear resistant support member 42 for cutter element 40*a, c, e,* as compared to that of elements 40*b, d* and *f.*

As understood by those skilled in the art, the wear resistance of such carbide support members 42 is dependent upon the grain size of the tungsten carbide, as well as the percent, by weight, of cobalt that is mixed with the carbide. In general, given a particular percent weight of cobalt, then the smaller the grain size of the carbide, the more wear resistant the support member 42 will be. Likewise, for a given grain size, the lower the percentage by weight of cobalt, the more wear resistant the support member will be. However, wear resistance is not the only design criteria for support members 42. The toughness of the carbide material must also be considered. In contrast to wear resistance, the toughness of the support member 42 is increased with larger grain size carbide and greater percent weight of cobalt.

It is presently industry practice to designate the composition of the tungsten carbide support member 42 by using a three digit designation, the first digit designating the grain size of the carbide, and the next two digits designating the percent weight of cobalt. Thus, the designation "310" refers to a tungsten carbide mixture having a carbide grain size 3, and a binder having 10% cobalt by weight. The designation "614" designates a carbide grain size 6, and a binder having 14% cobalt. The "614" material will be tougher but less wear resistant than the "310" material. Referring again to FIGS. 4 and 5, in the present invention, support members 42 of cutter elements 40*a, c* and *e* are preferably made from a more wear resistant material than that of support member 42 of elements 40*b, d* and *f.* More particularly, elements 40*a, c* and *e* may have supports 42 made of a carbide having the characteristic of a 3 grain size and a 10% cobalt content. In this example, cutter elements 40*b, d* and *f* would have support members 42 made from a less wear resistant composition, such as a carbide having a 6 grain size and 14% cobalt. Providing this alternating abrasion resistances in the carbide support members 42 will help maintain the desired cutting lip 62 and help create the stabilizing ridges 27 as shown in FIG. 5.

Figure 10:
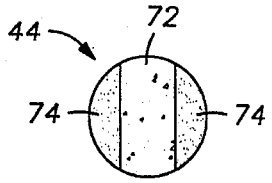
FIG. 10 is an elevation view of the cutting face of a cutter element made in accordance with an alternative embodiment of the present invention, the cutting face including regions having differing abrasion resistances.

Another alternative embodiment of the present invention is shown in FIG. 10. As shown, a cutter element 40*q* has a cutting face 44 that includes regions having different abrasion resistances. For example, the cutting face 44 includes a central region 72 having a high abrasion resistance that is bordered by peripheral regions 74 having abrasion resistances that are lower than that of region 72. Regions 74 may have identical abrasion resistances or they may differ, in which case cutting face 44 would include three regions of differing abrasion resistances. As one example, central region 72 may be coated with a diamond layer comparable to General Electric's 2700 Series, with the peripheral regions 74 having a diamond layer like General Electric's 2500 Series.

Figure 11:
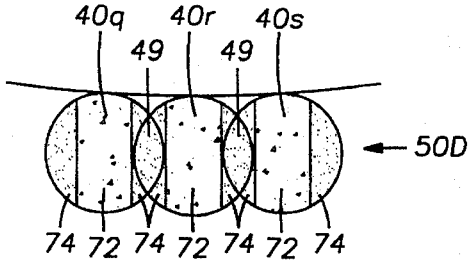
FIG. 11 is an elevation view, in rotated profile, showing the set cutting profile of a set of three radially and angularly spaced cutter elements having cutting faces as shown in FIG. 10.
Figure 12:
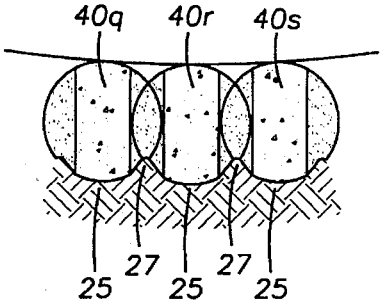
FIG. 12 is a view similar to FIG. 11, but showing the cutting profile of the cutter element set after some wear has occurred.

Referring to FIG. 11, a set 50D of cutter elements 40*q, r, s* having cutting faces 44 such as that shown in FIG. 10 are shown in adjacent radial positions. As shown in FIG. 11, the cutter elements 40*q, r, s* are radially spaced such that, in rotated profile, the peripheral regions 74 overlap in an area of multiple diamond density 49. These regions 49 having multiple diamond density will, like the regions 72 having a high abrasion resistance, resist wear longer than the portions of peripheral regions 74 that do not overlap with the cutting profiles of adjacent cutter elements 40. Accordingly, as abrasion occurs, the cutting profiles of elements 40*q, r, s* of set 50D will wear so as to provide the cutting profile shown in FIG. 12. This cutting profile will cause stabilizing ridges 27 and grooves 25 to be formed in the formation material and help resist bit vibration.

Figure 13:
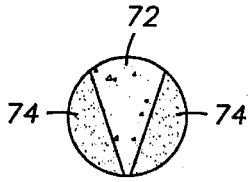
FIG. 13 is a view similar to that of FIG. 10 showing another alternative embodiment of the present invention.
Figure 14:
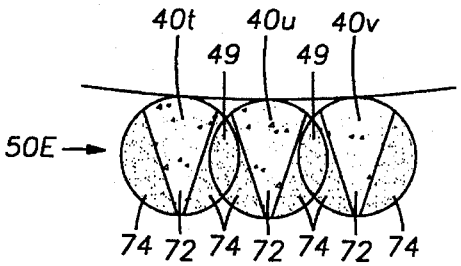
FIG. 14 is an elevation view, in rotated profile, showing the set cutting profile of a set of three radially and angularly spaced cutter elements having cutting faces as shown in FIG. 13.
Figure 15:
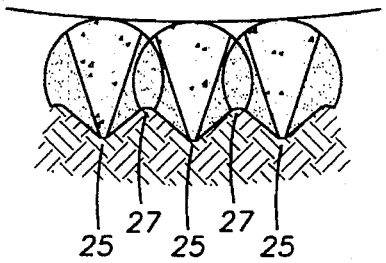
FIG. 15 is a view similar to FIG. 14, but showing the cutting profile of the cutter element set after some wear has occurred.

Referring to FIGS. 13–15, another alternative of the present invention is shown. As shown in FIG. 13, a cutter element 40*t* is provided having relatively high and low abrasion resistant regions 72, 74, respectively, as previously described with reference to FIG. 10. In this embodiment however, the region 72 of the cutting face 44 having the high abrasion resistance diamond layer may have an angular or scribe shape. Shown in rotated profile in FIG. 14 is cutter set 50E. Set 50E includes cutter elements 40*t, u, v* which are identical to cutter element 40*t* described above. As shown, these cutter elements are radially spaced such that their peripheral regions 74 overlap in a region of multiple diamond density 49. The cutting profile presented by cutter set 50E after wear has occurred is shown in FIG. 15. As shown, providing a pointed central region 72 with a diamond layer of high abrasion resistance surrounded by peripheral portions 74 having lower abrasion resistance diamond layers will provide pronounced grooves 25 and stabilizing ridges 27 in the formation material to stabilize the bit 10 and prevent bit vibration.

Figure 16:
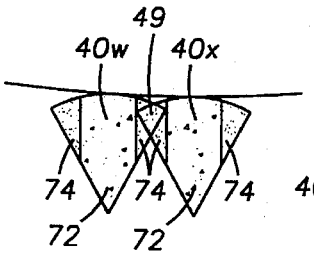
FIG. 16 is a view similar to FIGS. 11 and 14 showing another alterative embodiment of the invention which employs scribe cutters.

Although two shapes for regions 72 of high abrasion resistance have been shown and described, the present invention is not limited to the particular shaped regions 72, 74 of high and low abrasion resistant diamond layers shown in FIGS. 10 through 15. Instead, depending on the formation, size of cutter and other variables, the regions of varying abrasion resistance on cutter faces 44 may have any of a number of sizes and shapes. Likewise, although the cutting faces 44 of the cutter elements shown in FIGS. 10–15 have generally circular cutting profiles, scribe cutters 40*w, x* shown in FIG. 16 may likewise be employed in carrying out the principles of the present invention. Referring to FIG. 16, cutter faces 44 of cutter element 40*w*, 40*x* include a central region 72 having a diamond layer with a high abrasion resistances. Disposed on either side of region 72 are peripheral regions 74 having lower abrasion resistances. Cutter elements 40*w, x* are radially spaced such that their adjacent regions 74 overlap in region 49 of multiple diamond density. As cutter elements 40*w, x* wear, a relatively high ridge of formation material will be formed between cutters 40*w* and 40*x*, and relatively deep grooves will be formed adjacent to cutting tips 45. Together, such ridges and grooves will provide enhanced stabilization for bit 10.

Figure 17:
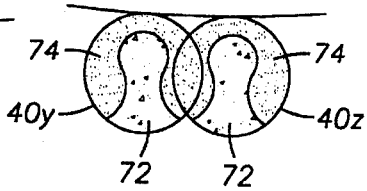
FIG. 17 is a view similar to FIGS. 11 and 14 showing another alternative embodiment of the present invention which includes cutter elements with cutting faces with irregularly shaped regions of differing abrasion resistance.
Figure 18:
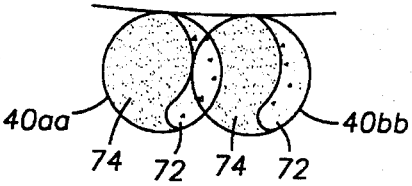
FIG. 18 is a view similar to FIGS. 11 and 14 showing another alterative embodiment of the invention which includes asymmetrically shaped regions of differing abrasion resistance on a cutting face.

FIGS. 17 and 18 show further embodiments of the invention, embodiments which also include cutter elements 40 having cutting faces 44 with regions 72, 74 of differing wear resistance. Referring first to FIG. 17, cutter elements 40*y* and 40*z* each include cutting faces having irregularly shaped and centrally disposed regions 72 of high abrasion resistance. High abrasion resistance regions 72, as shown in FIG. 17, do not extend across the full diameter of cutting faces 44 in elements 40*y*, 40*z*. Instead, regions 72 are shaped to include a centrally disposed lobe portion 72*a* and a peripherally positioned edge position 72*b* that forms the cutting tip of cutting face 44. A region 74 of lower abrasion resistance material is disposed on the remaining regions of cutting faces 44 such that regions 74 essentially surround lobes 72*a* of the cutter elements 40*y*, 40*z*. As shown, the regions 72, 74 of differing abrasion resistance of elements 40*y*, 40*z* meet in curved boundary lines and are substantially symmetrical.

In other cutting structure designs, employing asymmetrically shaped regions of differing wear resistance materials may be advantageous. For example, shown in FIG. 18, cutter elements 40*aa* and 40*bb* each include an asymmetrically shaped region 72 of high abrasion resistance material adjacent to an asymmetrically shaped region 74 which has a lower abrasion resistance than region 72. A cutting structure employing cutter elements with cutting faces 44 as that shown in FIG. 17 or 18 should provide a stabilizing effect as the cutter elements wear, the wear occurring faster in regions 74 having lower abrasion resistance.

Cutting faces 44 having regions 72, 74 of differing abrasion resistance as shown in FIGS. 10–18 may be manufactured using the techniques and processes commonly referred to as "tape casting" in conjunction with conventional High Pressure/High Temperature (HP/HT) diamond synthesis technology. Tape casting techniques are commonly used in the electronics industry to fabricate ceramic coatings, substrates and multilayer structures. U.S. Pat. Nos. 4,329,271 and 4,353,958 are examples of making ceramic cast tapes, and U.S. Pat. No. 3,518,756 is an example of using ceramic cast tapes to fabricate micro-electric structures, these three patents being incorporated herein by this reference. Additionally, a technical paper on tape casting technology written by Rodrigo Mareno-Instituto de Ceramica y Vedrio, CSIC—Madrid, Spain—in two parts—Volume 71, No. 10 (Oct. 1992) and Volume 71, No. 11 (November 1992) in the American Ceramic Society Bulletin is a comprehensive discussion on the technical means of ceramic tape management and is likewise incorporated herein by this reference. U.S. Pat. Nos. 3,743,556; 3,778,586; 3,876,447; 4,194,040 and 5,164,247 (all of which are also incorporated herein by reference) describe the use of similar tape casting technology using a fibrillated polymer temporary binder, such as polytetrafluroethylene (PTFE), to bind together into tape form a hard facing powder, such as tungsten carbide or the like, and a relatively low melting brazing alloy powder. This cast tape may be used to produce a wear-resistant carbide layer on a metallic substrate when heated to the liquidus temperature of the brazing alloy.

Applying these tape casting techniques to form the cutting faces 44 shown in FIGS. 10–18, the appropriately sized diamond grains are first mixed with a water compatible binder, such as high molecular weight cellulose derivatives, starches, dextrins, gums or alcohols. Polymer binder systems such as polyacrylonitrile, polyethylene, polyvinyl alcohol, polycarbonate polypropylene using various solvents and dispersants may also be employed. The diamond/binder mixture is mixed and milled to the most advantageous viscosity, rheology and homogeneity. It then is rolled into a strip (tape) of the desired thickness. The tape is then dried to remove the water or other volatile carders. The dried tape is flexible and strong enough in this state to be handled and cut into the desired shapes of regions 72, 74 shown in FIGS. 10–18.

Thus, to manufacture a PDC cutter element having a cutting face 44 such as that shown in FIG. 10, a segment of diamond tape formed using relatively small or fine diamond grains (with a binder) is cut or stamped into the elongate shaped region 72 shown in FIG. 10. Similarly, portions of a different diamond tape, one formed of coarser diamond grains and a binder, are cut into the shapes possessed by regions 74 in FIG. 10. The cut diamond tape segments are then disposed relative to one another in the positions shown in FIG. 10 in the bore or cavity of a containment canister as conventionally used in fabricating polycrystalline diamond composite compacts using HP/HT diamond synthesis technology. The preformed carbide substrate or support member 42 is next placed in containment canister so as to contact the diamond tape segments. An end plug or end member is then fit into the bore, and the materials are precompacted prior to the press cycle.

After being precompacted, the containment canister is heated in vacuo to drive off moisture and the diamond tape temporary binders. After the precompaction and preheating, the canister is then placed in a conventional HP/HT diamond synthesis press. The pressure, then temperature, are increased in the press to the thermodynamically stable region of diamond. The press cycle causes the diamond crystals to bond to each other, as well as to the carbide substrate material as the particles undergo high temperature and high pressures.

While the presently preferred embodiments of the invention have been shown and described, modifications thereof can be made by one skilled in the art without departing from the spirit and teachings of the invention. The embodiments described herein are exemplary only, and are not limiting. Many variations and modifications of the invention and the principles disclosed herein are possible and are within the scope of the invention. Accordingly, the scope of protection is not limited by the description set out above, but is only limited by the claims which follow, that scope including all equivalents of the subject matter of the claims.

What is claimed is:

1. A cutting structure for a drill bit comprising:

a bit face;

a first cutter element on said bit face having a first cutting face for cutting a kerf in formation material;

a second cutter element on said bit face having a second cutting face for cutting a kerf in formation material; and wherein said first cutting face has an abrasion resistance that is greater than the abrasion resistance of said second cutting face.

2. The cutting structure of claim 1 wherein said first and second cutting faces have cutting profiles that partially overlap when viewed in rotated profile.

3. The cutting structure of claim 1 wherein said first cutter element is mounted on said bit face in substantially the same radial position as said second cutter element, said first and second cutter elements being redundant cutter elements mounted on said bit face at different angular positions.

4. The cutting structure of claim 1 wherein said first and second cutting faces each include a diamond layer; and wherein said diamond layer of said second cutting face has an average diamond grain size that is at least twice as large as the average diamond grain size of said diamond layer of said first cutting face.

5. The cutting structure of claim 1 further comprising:

a set of cutter elements comprising a first plurality of cutter elements with cutting faces having abrasion resistances equal to the abrasion resistance of said first cutter element, and a second plurality of cutter elements with cutting faces having abrasion resistances equal to the abrasion resistance of said second cutter element; and wherein said cutter elements of said set are radially spaced along said bit face so as to provide a set cutting profile having regions of differing abrasion resistance.

6. The cutting structure of claim 5 wherein said set cutting profile comprises an alternating pattern of regions of differing abrasion resistances.

7. The cutting structure of claim 5 wherein said cutter element set comprises at least one cutter element of said second plurality mounted on said bit face at a radial position such that the cutting profile of said one cutter element overlaps in rotated profile with the cutting profiles of two cutter elements of said first plurality of cutter elements.

8. The cutting structure of claim 1 wherein said first and second cutter elements each include a support member supporting said cutting faces, and wherein said support member of said first cutter element is more resistant to abrasion than the support member of said second cutter element.

9. A drill bit for drilling a borehole through formation material when said bit is rotated about its axis, said bit comprising:

a bit body;

a bit face on said body, said bit face including a central portion, a shoulder portion adjacent to said central portion and a gage portion adjacent to said shoulder portion defining the diameter of the borehole;

a first plurality of redundant PDC cutter elements having cutting faces with a first abrasion resistance mounted in a first radial position on said bit face; and a second plurality of redundant PDC cutter elements having cutting faces with a second abrasion resistance that is less than said first abrasion resistance, said second plurality of cutter elements being mounted at a second radial position on said bit face that is spaced apart from said first radial position.

10. The drill bit of claim 9 wherein said first and said second plurality of PDC cutter elements are mounted in said central portion of said bit face.

11. The drill bit of claim 9 wherein said first and said second plurality of PDC cutter elements are mounted in said shoulder portion of said bit face.

12. The drill bit of claim 9 wherein said first plurality of redundant PDC cutter elements have cutting profiles that, in rotated profile, partially overlap the cutting profiles of said second plurality of redundant PDC cutter elements.

13. The drill bit of claim 12 further comprising:

a third plurality of redundant PDC cutter elements having cutting faces with said first abrasion resistance, said third plurality of cutter elements being mounted at a third radial position on said bit face that is spaced apart from said first and said second radial positions; and wherein said third plurality of redundant PDC cutter elements have cutting profiles that, in rotated profile, partially overlap the cutting profiles of said second plurality of redundant PDC cutter elements.

14. The drill bit of claim 9 wherein said cutting faces of said first plurality of PDC cutter elements have diamond layers that have a different average grain size than the diamond layers of said second plurality of PDC cutter elements; and wherein said diamond layers of said cutting faces of said second plurality of PDC cutter elements have an average diamond grain size that is at least twice as large as the average diamond grain size of said diamond layer of said cutting faces of said first plurality of PDC cutter elements.

15. The drill bit of claim 9 further comprising at least one PDC cutter element mounted on said bit face at said second radial position so as to be redundant with said second plurality of PDC cutter elements, wherein said one PDC element has a cutting face with a third abrasion resistance that is greater than said second abrasion resistance.

16. The drill bit of claim 15 wherein said third abrasion resistance is substantially equal to said first abrasion resistance.

17. The cutting structure of claim 9 wherein said cutter elements of said first and second plurality include support members supporting said cutting faces, and wherein said support members of said first plurality of cutter elements are more resistant to abrasion than the support members of said second plurality of cutter elements.

18. A cutting structure for a drill bit comprising:

a bit face;

cutter elements having PDC cutting faces disposed on said bit face, each of said cutter elements having an element cutting profile;

wherein said cutter elements include a first plurality of cutter elements having cutting faces with a first abrasion resistance and a second plurality of cutter elements having cutting faces with a second abrasion resistance that is less than said first abrasion resistance; and wherein said first and second plurality of cutter elements are arranged in sets on said bit face, each set including a set cutting profile defined by said element cutting profiles of said cutter elements in said set; and wherein a first set of cutter elements includes a first cutter element of said first plurality at a first radial position on said bit face and a second cutter element of said second plurality radially spaced from said first cutter element at a second radial position on said bit face, said element cutting profiles of said first and second cutter elements partially overlapping in rotated profile and forming adjacent regions within said set cutting profile, said adjacent regions including a first region having a relatively high abrasion resistance, a second region having an abrasion resistance that is less than said relatively high abrasion resistance, and a third region of multiple diamond density that is disposed between said first and second regions, said third region defined by the area of overlap between the cutting profiles of said first and said second cutter elements.

19. The cutting structure of claim 18 wherein said set cutting profile comprises an alternating arrangement of said first, second and third regions, and wherein said first and second regions in said arrangement are separated by one of said third regions of multiple diamond density.

20. The cutting structure of claim 18 wherein said set includes redundant cutter elements mounted at said first radial position having cutting faces of said first abrasion resistance and redundant cutter elements mounted at said second radial position having cutting faces of said second abrasion resistance.

21. The cutting structure of claim 20 further comprising at least one redundant cutter dement mounted in said second radial position that includes a cutting face of said first abrasion resistance, and wherein the number of cutter elements mounted at said second radial position having cutting faces of said first abrasion resistance is less than the number of cutter elements mounted at said second radial position that have cutting faces of said second abrasion resistance.

22. The cutting structure of claim 18 wherein said cutter elements include support members supporting said PDC cutting faces, and wherein said support members of said first plurality of cutter elements have a higher abrasion resistance than the support members of said second plurality of cutter elements.

23. The cutting structure of claim 18 wherein said cutting faces of said second plurality of cutter elements have diamond coatings with an average diamond grain size that is at least twice as great as the average diamond grain size of the diamond coating of the cutting faces of said first plurality of cutter elements.

24. A cutter element for a PDC bit comprising a substrate for supporting a cutting face;

a cutting face attached to said substrate, said cutting face having a first region covered with a diamond layer having a first abrasion resistance and a first average diamond grain size and a second region covered with a diamond layer having a second abrasion resistance that is less than said first abrasion resistance and a second average diamond grain size that is greater than said first average diamond grain size.

25. The cutter element of claim 24 wherein said first region is generally centrally located on said cutting face.

26. The cutter element of claim 24 wherein said first region is generally centrally located on said cutting face, and wherein said cutting face includes a pair of said second regions, said first region being disposed on said cutting face between said pair of second regions.

27. The cutter element of claim 24 wherein said first region includes a pointed portion.

28. The cutter element of claim 24 wherein said first and second regions are asymmetrically shaped.

29. The cutter element of claim 24 wherein said first and second regions meet at boundary lines, and wherein said boundary lines are curved.

30. The cutter element of claim 24 wherein said first region includes a centrally-disposed lobe portion.

31. The cutter element of claim 23 wherein said second region has an average diamond grain size that is at least twice as large as the average diamond grain size of said first region.

32. A cutting structure for a drill bit comprising:

a bit face;

a first PDC cutter element on said bit face having a first cutting face for cutting a kerf in formation material; and a second PDC cutter element on said bit face having a second cutting face for cutting a kerf in formation material;

wherein said first and second cutting faces each include a first region and a second region and wherein said first region of each of said cutting faces has a higher abrasion resistance than said second region of said same cutting face, said first and second regions having different average diamond grain sizes; and wherein said first and second cutting faces have cutting profiles that partially overlap when viewed in rotated profile.

33. The cutting structure of claim 32 wherein said first and second cutting faces overlap in said peripheral regions.

34. The cutting structure of claim 30 wherein said average grain size of the diamond layer in said second regions of each of said cutting faces is at least twice as large as the average grain size of the diamond layer in said first regions.

35. The cutting structure of claim 32 wherein said first and second cutter elements each include a pair of said second regions, and wherein said pair of second regions of said first cutting face have different abrasions resistances.

36. The cutting structure of claim 32 wherein said first and second cutter elements each include a pair of said second regions, said first region being disposed between said second regions, and wherein said central region of said first cutting face has an abrasion resistance that is different from said abrasion resistance of said central region of said second cutting face.

* * * * *